US007036958B2

(12) United States Patent
Hayne et al.

(10) Patent No.: US 7,036,958 B2
(45) Date of Patent: May 2, 2006

(54) LIGHTING BALLOON

(75) Inventors: Rawdon John Hayne, Reading (GB); Robert William Jeffs, Northolt (GB)

(73) Assignee: Leelium Balloons Limited, London (GB)

( * ) Notice: Subject to any disclaimer, the term of this patent is extended or adjusted under 35 U.S.C. 154(b) by 225 days.

(21) Appl. No.: 10/432,907

(22) PCT Filed: Nov. 29, 2001

(86) PCT No.: PCT/GB01/05269

§ 371 (c)(1),
(2), (4) Date: Oct. 15, 2003

(87) PCT Pub. No.: WO02/44613

PCT Pub. Date: Jun. 6, 2002

(65) Prior Publication Data

US 2004/0062035 A1 Apr. 1, 2004

(30) Foreign Application Priority Data

Nov. 29, 2000 (GB) ..... 0029124

(51) Int. Cl.
*F21V 1/06* (2006.01)

(52) U.S. Cl. ..... 362/352; 362/253; 362/363; 362/376

(58) Field of Classification Search ..... 362/352, 362/363, 253, 217, 376–378, 234
See application file for complete search history.

(56) References Cited

U.S. PATENT DOCUMENTS

| | | | | |
|---|---|---|---|---|
| 3,592,157 A | | 7/1971 | Schwartz | |
| 3,893,123 A | * | 7/1975 | Bieser | 343/706 |
| 4,126,850 A | * | 11/1978 | Randolph | 340/983 |
| 5,782,668 A | | 7/1998 | Chabert | |
| 5,931,412 A | | 8/1999 | Carloni | |
| 6,012,826 A | * | 1/2000 | Chabert | 362/363 |
| 6,142,415 A | | 11/2000 | Ambrico | |
| 6,227,484 B1 | * | 5/2001 | Miyake | 244/31 |
| 6,238,067 B1 | | 5/2001 | Hirsch | |

FOREIGN PATENT DOCUMENTS

| | | |
|---|---|---|
| DE | 3305969 A | 8/1984 |
| EP | 0679413 A | 11/1995 |
| EP | 0834693 A | 4/1998 |
| GB | 2166538 A | 5/1986 |
| GB | 2265592 A | 10/1993 |
| JP | 04263290 A | 9/1992 |
| JP | 09274460 A | 10/1997 |

* cited by examiner

OTHER PUBLICATIONS

Wenzel Rolf, Sonne, Mond und . . . Leuchtballon, Femseh und Kinotechnik, VDE Verlag GmbH, vol. 51, No. 1/2, 1997, pp. 54-55, Berlin, Germany.

*Primary Examiner*—Thomas M. Sember
*Assistant Examiner*—James W Cranson, Jr.
(74) *Attorney, Agent, or Firm*—Stites & Harbison PLLC; Ross F. Hunt, Jr.

(57) ABSTRACT

A lighting balloon is filled with a buoyant gas, such as helium, and carries a light source. To enable the balloon to withstand the rigours of field application and to be rapidly deployable, the light source may be installed in a cage and/or the ballon may be aerodynamically shaped or provided with stabilising fins; this may enable external lighting to be provided by a lighting a balloon for practical application where static lighting was previously required.

17 Claims, 5 Drawing Sheets

LIGHTING BALLOON

The present invention relates to balloons for suspended lighting. It is particularly, but not exclusively, concerned with providing lighting on a temporary but re-usable basis, for example for film sets or for emergency lighting.

Conventionally, lighting installations for film sets have required considerable time and effort to set up and bulky scaffolding or other support equipment. This may limit access to certain confined spaces.

We have proposed that lighting equipment be suspended within a buoyant, preferably helium filled balloon. Because the balloon is buoyant, it does not require a supporting structure and can readily and rapidly be manoeuvred into place. Another advantage of helium-filled balloons is that the helium tends to circulate within the balloon producing a cooling effect.

To produce large amounts of high intensity light, expensive and delicate bulbs are required and high voltage/high current cables are required to power the bulbs. To suspend these bulbs, given that a helium balloon typically produces about 1 kilogram of lift per cubic meter and that this must lift the balloon envelope as well as all fittings, balloons are typically provided with a volume of 1–20 cubic meters although smaller or larger balloons are of course possible.

Although a spherical balloon is the most compact shape, the sphere having the highest volume-surface area ratio of any shape, we have found that, for serious lighting purposes, a generally cylindrical balloon having a substantially horizontal axis is more convenient, preferably with approximately half the circumference containing or coated with a reflective material so that light can be directed primarily in the desired direction. A balloon having a volume of about 12 cubic meters may have a diameter of the order of two meters and a length of the order of four meters. It will be appreciated that assembling and transporting the balloon, even when deflated, may be somewhat problematic although considerably less problematic than the conventional scaffolding arrangement that may otherwise be required. For certain applications, particularly outdoors, the balloons may be shaped aerodynamically, for example similar to barrage balloons. A spherical balloon is not suited to external deployment at an exposed location.

We have previously proposed that the lights be mounted on poles extending generally along the axis of an elongate balloon and secured to the end walls of the cylinder. The poles are preferably dismountable or collapsible into one or more shorter sections, for example in the manner of a fishing rod. This reduces the size required to transport the balloon in the deflated state but installation of the light mounts on the poles and assembly of the poles together with positioning of the poles within the balloon and resealing of the balloon adds to installation time.

The invention is particularly, although not exclusively, concerned with balloons which are re-usable, that is which may be deployed a number of times. For such applications, particularly for a balloon which may be subject to the rigours of repeated installation at a site (such as a film set), there is a risk of bulb damage. It has generally been considered desirable that the delicate and expensive bulbs can be separated from the mounting assembly and transported separately so that they can be installed immediately prior to final assembly and inflation of the balloon to minimise the risk of damage. This, however itself introduces problems of handling the bulbs.

It is noted that, for less demanding applications, for example where relatively cheap bulbs are used or where the balloon is not expected to be re-used multiple times, a bulb may be simply suspended within a typically spherical balloon. Whilst this may be suitable for effectively disposable installations, bulb damage is likely. A distinction can be drawn between arrangements for serious lighting applications and decorative lighting; arrangements which are suitable to provide general decorative lighting cannot normally be applied to the problem of providing desired, for example directional, lighting. A disposable entertainment balloon is not suited to film production or re-usable emergency lighting, each of which is a particular but not exclusive concern of the invention, where reliability is a concern.

It is a general aim of at least a first aspect of the invention to provide an arrangement for mounting a bulb within a balloon in a manner which facilitates rapid assembly or deployment but without unduly compromising bulb life.

According to a first aspect, the invention provides apparatus for mounting a lighting bulb within the envelope of a buoyant balloon, the apparatus comprising a cage, the cage having suspension means for mounting a bulb generally within the cage, and means for suspending the cage within the balloon.

Surprisingly, mounting the bulb within a cage (even though the cage will itself be enveloped by the balloon) can facilitate assembly as the bulb can be pre-installed in the cage and deployment of the cage within the balloon may be simpler or less risky overall than attaching the bulb to a mounting structure.

The cage may contain a pre-installed bulb, particularly a discharge bulb. The suspension means preferably comprise generally elongate preferably flexible members, for example ropes, cords, cables or wires. Means are typically provided to facilitate attachment to the balloon envelope. A single suspension member may be employed to suspend the assembly from the upper part of the balloon envelope and two diametrically opposed members can in principle constrain the movement. However, we have found that, particularly in the case of an elongate cylindrical balloon, a surprising improvement in stability can be achieved if a plurality of suspension members are used. A particularly advantageous arrangement is found when the balloon is generally elongate, and the cage is generally elongate the axis of elongation of the cage being generally aligned with the axis of elongation of the balloon. Preferably, the bulb is elongate and the axis of the bulb is generally aligned with the axis of the cage. In such a case, it is most advantageous to have at least two suspension members adjacent one end of the cage and at least two suspension members adjacent the other end of the cage. Thus, the suspension members are preferably mounted at spaced apart locations along the axis of the cage and at spaced apart locations about the circumference of the cage. More preferably, there are at least three suspension members attached adjacent each end of the cage more preferably four or even more suspension members. Thus, the cage is preferably secured to the balloon envelope by at least four attachment points, ideally at least six spaced apart attachment points. Preferably the attachment points do not all lie in the same place. Such measure are found to provide much greater stability and reduce strain at the attachment points of the envelope, without unduly affecting weight.

The cage may be pre-secured to the balloon envelope by means of the suspension members. The invention extends to a lighting balloon having at least one cage suspended therein, the cage having means for mounting a bulb within the cage, preferably in accordance with any of the proceeding aspects. The invention further comprises a kit comprising a cage, preferably as defined above, a bulb, a balloon envelope and preferably also a supply of buoyant gas, preferably helium.

The cage may define a substantially cylindrical bulb receiving region. Preferably, the cage comprises a pair of substantially circular end members maintained spaced apart by a plurality of elongate longitudinal members, the bulb receiving region being defined between the longitudinal members. Whilst spacing the end members by only a pair of longitudinal members or, if the member is sufficiently rigid only a single longitudinal member may provide enhanced protection for the bulb, preferably at least three longitudinal members are provided, preferably approximately evenly spaced around the circumference of the end members, more preferably approximately four longitudinal members are provided. It will be appreciated that the end members need not be exactly circular and may be polygonal, ellipsoidal or irregular shapes. Similarly, the longitudinal members need not be evenly spaced.

The function of the cage is to protect the bulb by inhibiting contact with the bulb and the shape may vary depending on the degree of protection, the shape and size of the bulb and anticipated environment. If a large number of longitudinal members are provided, this may improve protection but may impair light output. The cage is preferably shaped so that, when placed on a flat surface, the bulb is inhibited from contacting the surface and preferably is shaped so that no part of the bulb can contact the surface in any orientation of the cage.

A substantially solid or continuous cage may be provided, for example of a transparent material. This may affect heat transmission from the bulb; in some cases this may be desirable to increase the operating temperature of the bulb but in others it may be desirable to include ventilation apertures. In a preferred development, the cage has means for mounting a filter to colour the light output by the bulb. This may enable light of a desired colour to be produced without requiring a large filter on the exterior of the balloon. Preferably, the cage has means for mounting a filter at least partially or substantially surrounding the bulb. However, in certain cases only a portion of the light may be filtered.

To facilitate connection of multiple bulbs in a balloon, the cage preferably has means for carrying a conductor from one longitudinal end of the cage to the other, preferably with or within one or more longitudinal arms of the cage. This may facilitate, for example making connection at either or a single desired end of the balloon or facilitate connection of multiple balloons.

More than one cage may be provided in the balloon, most preferably in the case of an elongate balloon two cages each containing a light source are provided within the balloon spaced apart along the axis of the balloon. This can provide more efficient/even lighting over a longer area than a large single source or multiple separate sources.

The cage is preferably arranged to accommodate a discharge bulb and preferably includes voltage booster means for boosting voltage supplied from a power supply to a voltage sufficient to ignite the discharge. This is particularly advantageous as it allows the voltage supplied up the flying cable to the balloon to be kept to a safer lower value. However, whilst the balloon preferably contains voltage booster means, the majority of the power supply is preferably located elsewhere, to reduce the weight in the balloon.

In a further aspect, the invention provides a lighting balloon containing a discharge lamp and a power supply connectable to the balloon by means of a power cable, the power supply having means for applying starting power to start the discharge lamp and for supplying sustained power to power the lamp to maintain the discharge, the balloon containing voltage booster means for boosting the voltage supplied to the lamp when said starting power is applied.

The balloon may have connector means for receiving a power supply to power the lamp, the connector means being mounted on a face of the balloon, preferably on an end wall of the balloon.

The balloon may further include means for receiving a supply of buoyant gas preferably adjacent the power supply connector means, preferably arranged to receive the gas from a conduit associated with a cable connected to the power connector means.

The invention is most preferably deployed in balloons having a volume of at least 1 cubic meter, preferably at least 3 cubic meters and preferably having a bulb of output of at least 500 watts, preferably at least 1 kilowatt, typically of the order of 5–10 kilowatts.

The invention further extends to methods of assembling a lighting balloons. In a first method aspect, the invention provides a method comprising installing a bulb in a cage, preferably in accordance with the first aspect, and attaching the cage within the envelope of a balloon to be suspended therein when the balloon is filled with a buoyant gas. The method typically further comprises inflating the balloon with a buoyant gas, preferably helium.

In a further aspect, the invention provides apparatus for providing external lighting at an exposed external location comprising:

- a balloon envelope for containing a quantity of buoyant gas sufficient to provide lift to the apparatus;
- a light source;
- means for supplying power to the light source;
- means for suspending the light source from the balloon envelope;
- means for attaching the balloon envelope to a tether;
- wherein the balloon envelope is configured to resist deflection by wind when attached to the tether.

The balloon envelope may have one or more external stabilisers such as one or more fins or aerofoils. These may be integral with the balloon or provided as separate members. The balloon may have a tapered cylindrical shape. The light source is preferably mounted in the balloon envelope, but may be externally mounted, preferably so as in use to lie on the underside of the balloon. The light source is preferably mounted in a cage in accordance with the first aspect or any of its preferred features.

The balloon is preferably arranged to be substantially stable in light winds (up to approximately 10 km/h) when secured by a single tether point. Surprisingly, we have found that this is achievable by provision of one or more fins to provide lateral stability and one or more fins or an overall shape to provide lift to counteract downforce. Previously, lighting balloons were not considered suitable for serious deployment at an external exposed location (by which is preferably meant a location having appreciable wind, for example more than 5 km/h).

The balloon preferably has a reflector, preferably a reflective layer, preferably in at least an upper portion thereof, to reflect a portion of light from the light source in a desired direction, preferably downwardly. The reflective layer may advantageously comprise a metallic foil or metallised film (such as a mylar film) formed as a layer with a portion of the balloon envelope, particularly using an aluminium layer.

The power is preferably supplied by a power cable from a supply on the ground. However, in some cases, particularly for larger balloons, a battery or generator may be carried by the balloon.

The balloon may have active stability controls, for example servo-deflected stabilisers, and/or a powered propulsion system to aid positioning/stability. However, passive stabilisers are generally lighter and simpler to implement.

In a general aspect, the invention provides use of a tethered (preferably aerodynamically shaped) buoyant balloon carrying a light source to provide external lighting at an exposed location.

A method of lighting an external location subject to exposure to a wind of greater than 5 km/h, the method comprising comprising deploying a buoyant balloon carrying a light source at the location, the balloon having a (preferably aerodynamic) shape selected to provide stability in wind, the method further comprising supplying power to the light source.

The balloon may be tethered primarily at a single main tether point, the main tether point securing the balloon and preferably providing a connection point to a power source. Supplementary tethers may be deployed in certain cases.

By aerodynamically shaped is preferably meant non-spherical and having an overall shape and/or external member which generates lift to counteract at least partially wind deflection (i.e. the lift acts in a direction to oppose the deflection that would occur in the case of a spherical balloon).

An embodiment of the invention will now be described, by way of example, with reference to the accompanying drawings in which.

Figure 1:
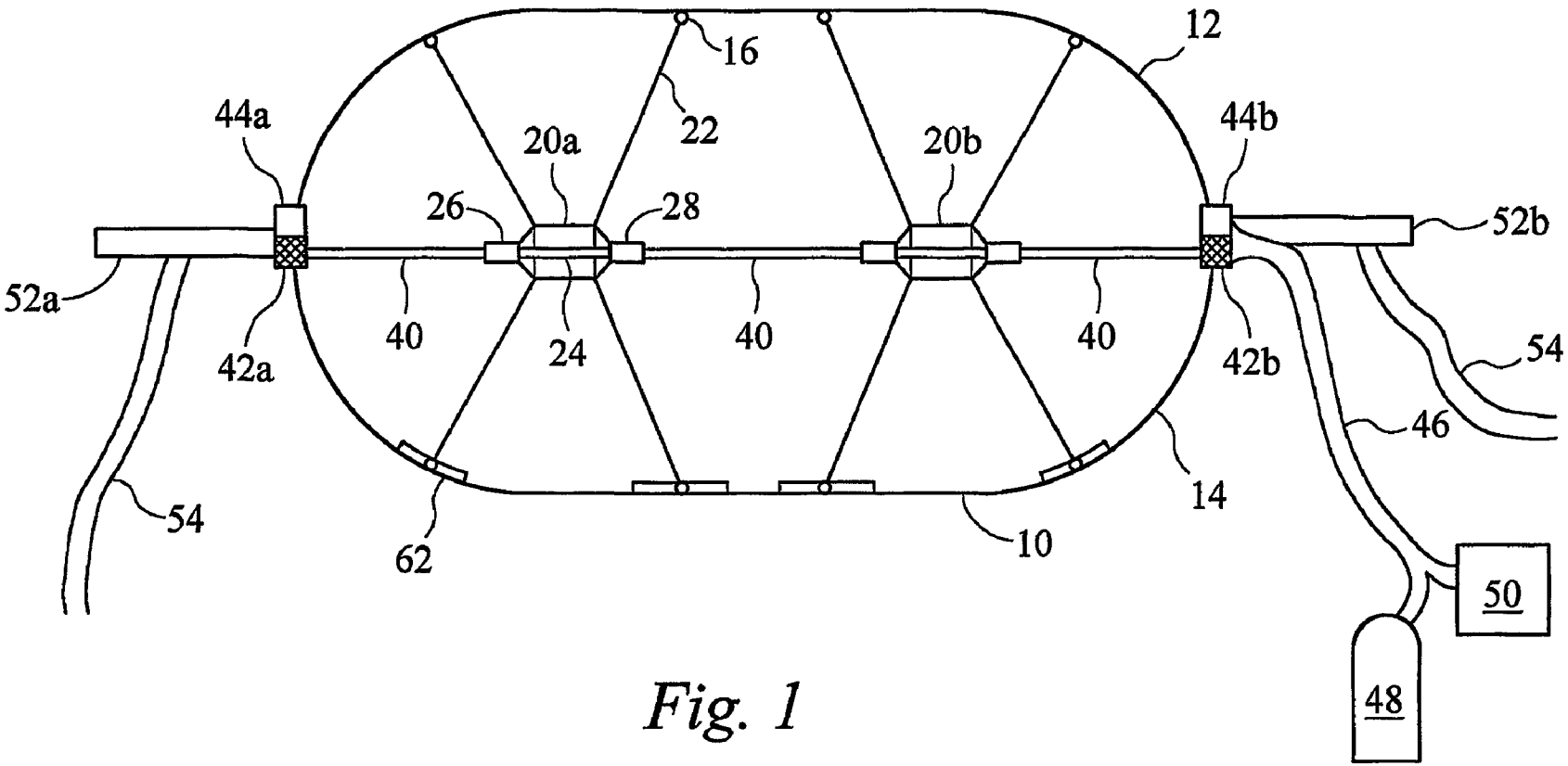
FIG. 1 is a schematic sectional view of a balloon in accordance with an embodiment of the invention.

Referring to FIG. 1, a balloon envelope 10 is formed from a suitable material, suitably a lightweight flexible material, preferably a laminate including an ultra-violet absorbing or blocking layer and a layer providing necessary structural and/or gas barrier properties. It is noted that helium will diffuse through most substances and so an amount of leakage is to be expected. Preferably, an upper portion of the balloon 12 has a further reflective layer, for example, Mylar, aluminium foil or other metallised layer, and the lower portion 14 is light-transmissive; this may be transparent or more preferably translucent, in order to produce diffuse lighting. The balloon may have transparent end windows to enable the position of the cages to be checked. Preferably integrated into the ballon walls are one or more airtight zipper seals or other removable or openable panels, preferably again at at least the end walls, to enable the cages to be installed and replaced. It has been found that seals for diving or more preferably biological protection suits may provide suitable airtight zipper seals. Alternatively, simple "udder" type seals may be used to provide access to the interior as have been used for hot-air balloons and the like.

Mounted within the balloon are two cages 20*a*, 20*b* suspended by suspension cords 22 from the balloon envelope 10, and preferably attached to the envelope by means of attachment points 16 which may be provided at reinforced locations 62 or seams. Each cage contains a daylight discharge bulb 24 and has a connector 26 at one end and encapsulated high voltage booster electronics 28 at the other end. Alternatively, the electronics may be provided in the middle of the balloon. The cage is generally suspended so that the bulb is at least about 30 cm, at least for a bulb of 500 W, or more from the balloon envelope.

The cages are preferably made from lightweight but heat-resistant material. Aluminium may be used. The material preferably has a density of no more than about 3000 kg per cubic meter. Heat resistant composites, preferably able to withstand at least 100 degrees Celsius, more preferably at least 200 degrees may be used, particularly fibre-reinforced composites.

Figure 2:
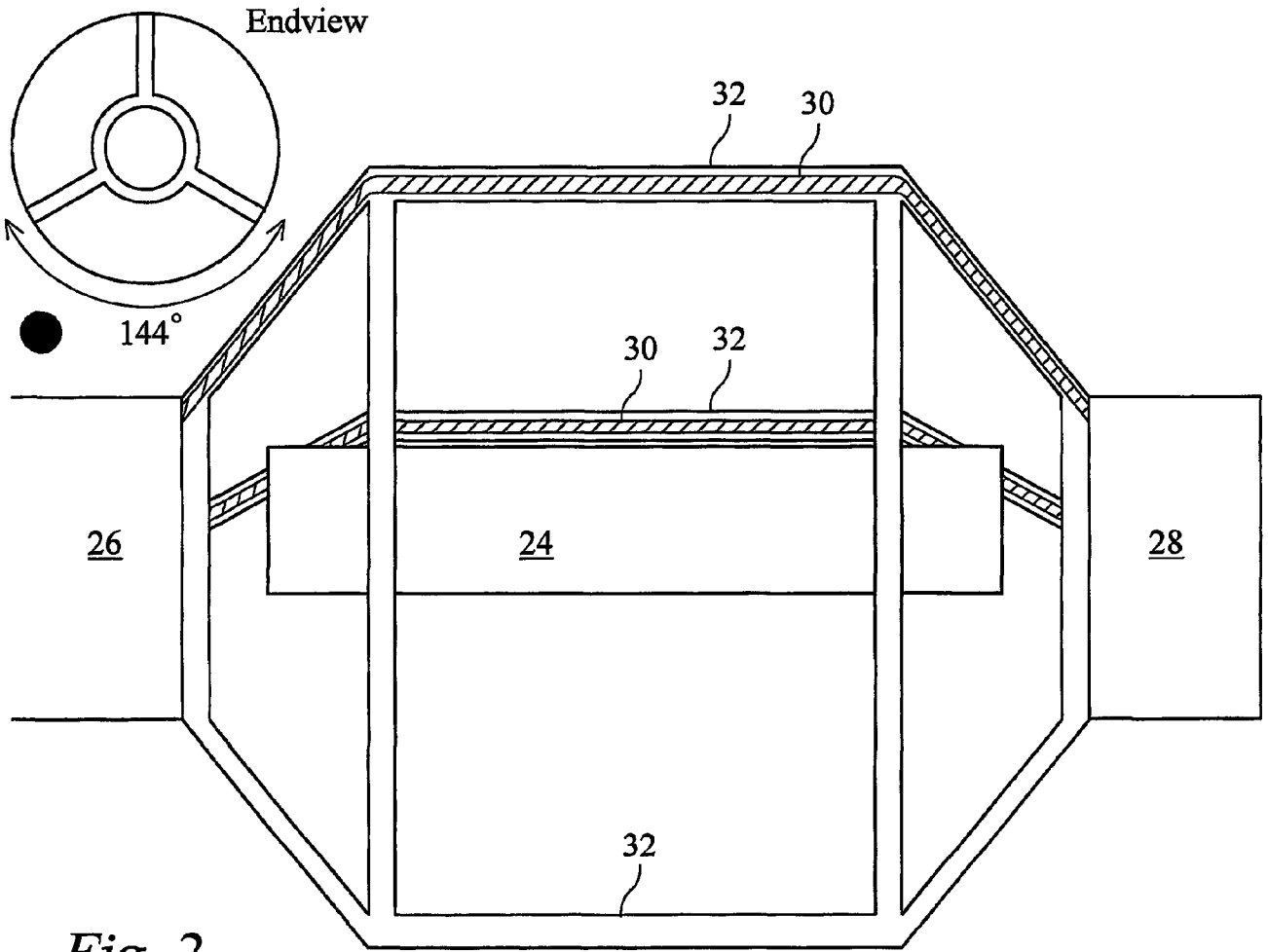
FIG. 2 is an enlarged view of a cage according to the invention.

As can best be seen from FIG. 2, cables 30 extend through at least some of the longitudinal arms 32 (here three are used and two cables are carried) of the cage between end annular sections 34. The two cages 20*a*, 20*b* are spaced apart approximately symmetrically about the mid point of the axis of the balloon 10 and preferably the encapsulated high voltage electronics 28 are disposed towards the centre of the balloon, to improve balance and weight distribution. High voltage connector cable 40 extends between the two lighting units 20*a*, 20*b* and to two connectors 42*a*, 42*b* one on each end wall of the balloon. A connector may be provided only at one end if desired. Helium filler connectors 44*a*, 44*b* are also located on the end walls adjacent the high voltage connectors so that a compound cable 46 attached to a helium source 48 and power supply 50 can supply both power and top-up helium to the balloon. Whilst the longitudinal arms are generally evenly spaced, in this embodiment the arms are spaced further apart (144 degrees), adjacent the primary light exit direction (at the bottom) than elsewhere, here on the sides (108 degrees).

Figure 3:
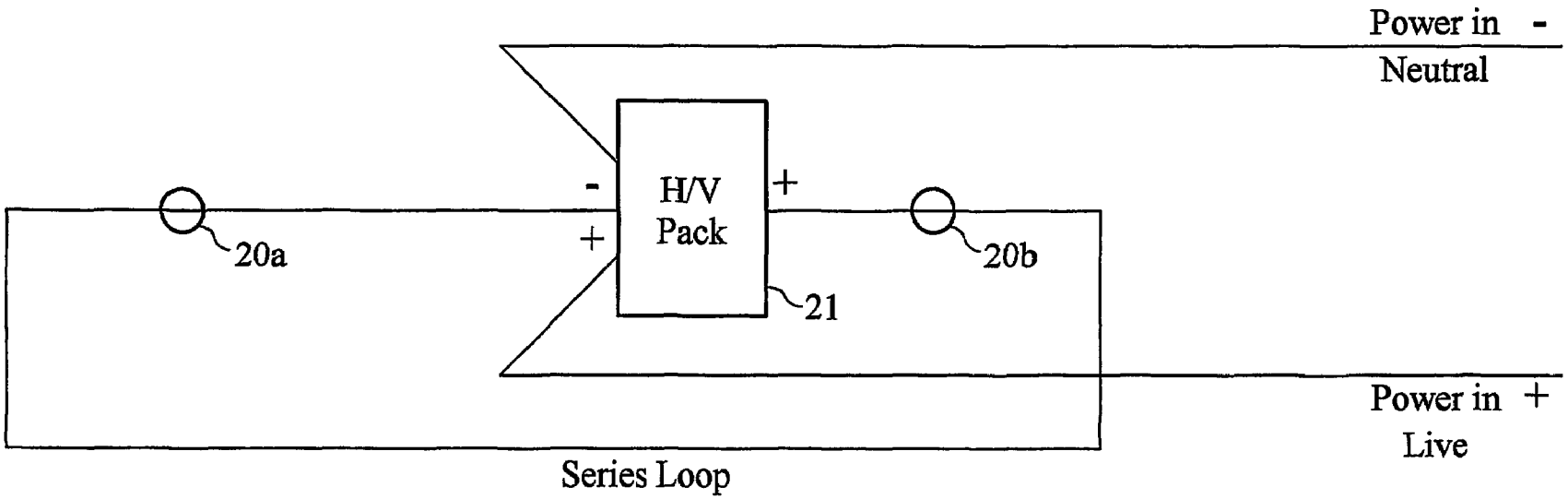
FIG. 3 is a schematic wiring diagram of the connections inside the balloon.

FIG. 3 shows schematically a suitable the wiring arrangement for the system of FIG. 1, with two bulbs 20*a*, 20*b* wired in series with a high voltage booster 21, which may be mounted on the end of one of the cages or suspended in the middle of the balloon. High voltage power from the power supply 50 is fed into the voltage booster 21.

In the embodiment shown in FIG. 1, there are four cords 22 attached to each end of each cage giving a total of eight fixing points per cage, only half of which are shown in FIG. 2. This is found to provide a particularly stable arrangement, allowing the balloon to be used in variety of orientations. The lighting units are preferably located substantially along the central longitudinal axis of the balloon, so that the centre of gravity is coincident with the axis, allowing the balloon to be readily rotated, for example to provide sideways or even upward lighting as required. In alternative embodiments, however, the lighting may be offset from, typically located below the longitudinal axis of the balloon so that the balloon naturally assumes a preferred downward (or otherwise) directed configuration. Other ballast may be provided to adjust the position of the centre of gravity. The balloon has extending end shafts 52*a*, 52*b* extending from each end and tether ropes 54 to enable it to be attached in a desired position. These tether ropes may be attached to the shafts as shown or directly to the balloon, for example by means of attachment hooks or loops secured to the balloon envelope. Velcro™ or other suitable quick-release or more permanent fixings may be provided along the edge of the balloon, typically at the seam joining the upper reflective half (or other proportion) 12 to the lower light-transmissive portion 14 to enable skirts to be attached; an advantage of using an elongate cylinder is that a rectangular skirt may readily be used to shield certain directions.

The embodiment shown typically has a length of about 4 meters and a diameter of about 2 meters and contains two 2.5 kilowatt daylight discharge bulbs; this is a convenient size for film set lighting. It will, of course, be appreciated that more or brighter bulbs may be included and bigger balloons may be used to light extended areas. In addition, multiple balloons may be provided and an advantage of having feed-through connectors is that multiple balloons may be connected into a single high voltage feed, simplifying installation.

Smaller balloons may be provided for other purposes, for example emergency lighting, for example at an accident scene. For example, for a kit for portable emergency lighting, a cage may be pre-assembled within a balloon and a high pressure source of helium may inflate the balloon envelope within a matter of minutes allowing a bright overhead light source to be deployed. For outdoor use, the balloon may be aerodynamically shaped or provided with fins or aerofoils and a suitable tether location chosen to provide stability in windy conditions. By aerodynamically shaped is preferably meant non-spherical and having an overall shape and/or external member which generates lift to counteract at least partially wind deflection (i.e. the lift acts in a direction to oppose the deflection that would occur in the case of a spherical balloon). The whole assembly can conveniently be packaged in a trailer or other convenient package and, since the bulb is preinstalled, can be deployed by a relatively unskilled user simply by activating the inflation device.

For a lighting balloon for external use, the envelope preferably has a capacity of at least 8 cubic meters (although in certain cases slightly smaller balloons may be used) and preferably is no larger than about 250 cubic meters (larger sizes may require complex tethering and/or propulsion to manage). The light output is preferably at least 5 kw, more preferably at least 10 kw, and may be 20 kw, 50 kw or even more. In one preferred implementation, multiple (2 or more, for example 5 or more, even up to about 10 or more) lamps of a plurality of kilowatts each are used (for example 2.5 kw or greater HMI lamps). In an alternative implementation, a higher power lamp is provided, for example a lamp having a power of at least 10 kw. A xenon arc lamp of in excess of 10 kw (a single lamp of 50 kw, or more may be used) may be used.

The stabilising fins are, in one embodiment, preferably not filled with the buoyant gas from the main body of the balloon. They may be air filled, either by an air collector on the front of the balloon or, preferably, in a balloon which may be used in sheltered locations as well as exposed locations, maintained filled by one or more fans for directing external air into the fins; this is a particularly advantageous arrangement for a lighting balloon, particularly a balloon with internal lighting as the buoyant gas can circulate in the main envelope and carry heat from the light source independently of the fins, the fins remaining inflated even if pressure in the main envelope drops.

Figure 4:
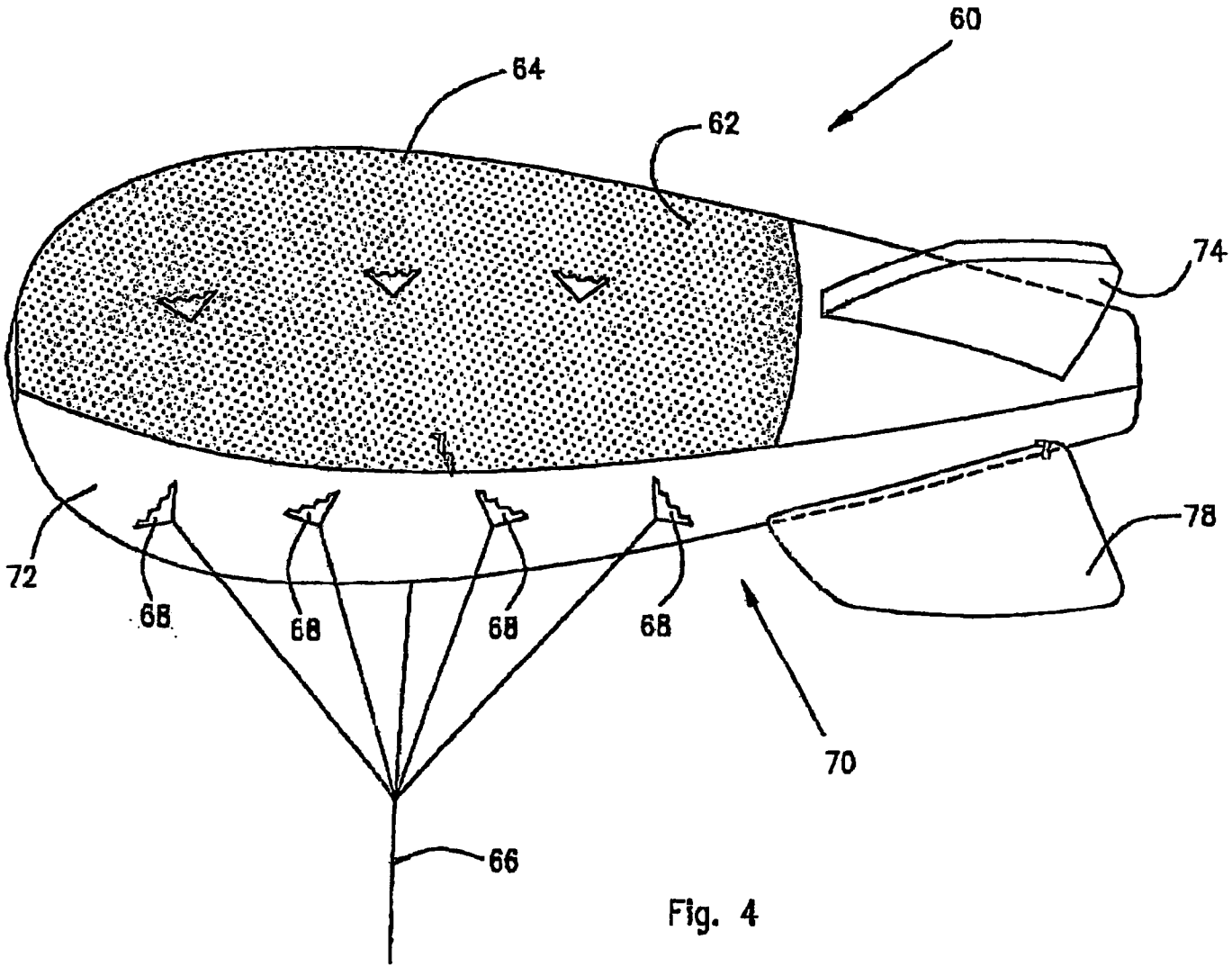
FIG. 4 depicts an aerodynamically shaped balloon.
Figure 5:
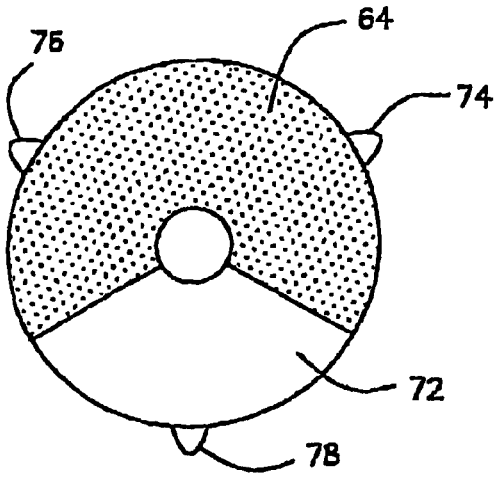
FIGS. 5 and 6 depict respectively front and rear views of the balloon of FIG. 4.
Figure 6:
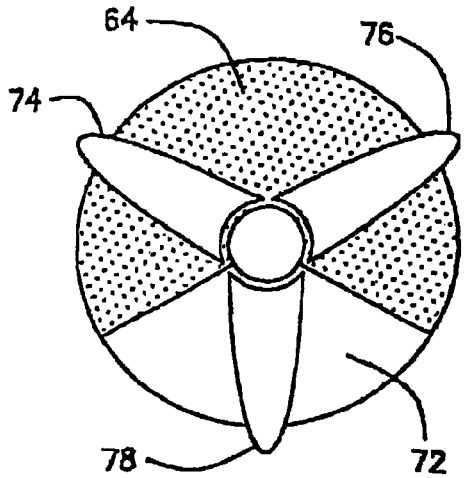

Referring now to FIGS. 4–6, an exemplary embodiment of an aerodynamic balloon 60 is shown. Referring now in particular to FIG. 4, a perspective view of an aerodynamic lighting balloon 60 is shown. Aerodynamic lighting balloon 60 has a tapered cylindrical body 62 having reflective material 64 provided on an upper surface thereon. A tether 66 attaches to body 62 at multiple attachment points 68. A lower surface 70 of body 62 is made of a light transmissive material 72. A first fin 74, a second fin 76 and a rudder 78 are provided to stabilize the balloon in windy conditions. Preferably, fins 74 and 76 have a shape that provides lift to the balloon 60 when balloon 60 encounters winds. The lift assures that balloon 60 will not be forced downward by winds.

Supplemental external lights 106 are suspended beneath balloon 90. Although supplemental lights 106 are shown exteriorly to balloon 90, it should be understood that balloon 90 may be used with lights located only inside of body 92, only outside of body 92 or used in combination. Similarly, balloon 60 (FIG. 4) may optionally be fitted with supplemental external lighting.

Figure 7:
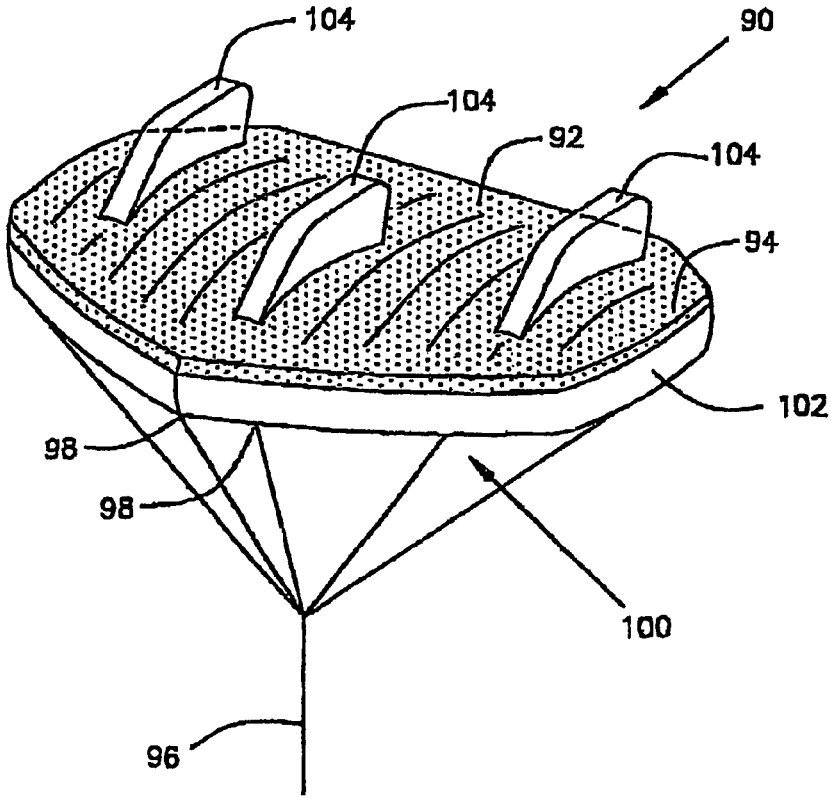
FIG. 7 depicts an alternative embodiment.

Referring now to FIG. 7, a wedge shaped balloon embodiment 90 is shown. Wedge-shaped balloon 90 has a wedge-shaped body 92 having reflective material 94 provided on an upper surface thereon. A tether 96 attaches to body 92 at multiple attachment points 98. A lower surface 100 of body 92 is made of a light transmissive material 102. Stabilizer fins 104 are provided to stabilize the balloon in windy conditions. Preferably, wedge-shaped body 92 has a shape that provides lift to the balloon 90 when balloon 90 encounters winds. The lift assures that balloon 90 will not be forced downward by winds.

While the invention has been described with a certain degree of particularity, it is understood that the invention is not limited to the embodiment(s) set forth herein for purposes of example.

Other applications modifications and developments will become apparent.

The invention claimed is:

1. Apparatus for providing external lighting at an exposed external location comprising:

a balloon envelope for containing a quantity of buoyant gas sufficient to provide lift to the apparatus;

a light source;

means for supplying power to the light source;

means for suspending the light source from the balloon envelope;

means for attaching the balloon envelope to a tether;

wherein the balloon envelope is configured to resist deflection by wind when attached to the tether;

wherein the means for suspending the light source from the balloon envelope comprises a cage, the cage having means for mounting a bulb within the cage, and suspension means for suspending the cage within the balloon; and wherein the suspension means for suspending the cage within the balloon comprise elongate, flexible members and wherein the apparatus further comprises means for attaching the suspension means to the balloon envelope.

2. Apparatus for providing external lighting at an exposed external location comprising:

a balloon envelope for containing a quantity of buoyant gas sufficient to provide lift to the apparatus;

a light source;

means for supplying power to the light source;

means for suspending the light source from the balloon envelope;

means for attaching the balloon envelope to a tether;

wherein the balloon envelope is configured to resist deflection by wind when attached to the tether;

wherein the means for suspending the light source from the balloon envelope comprises a cage, the cage having means for mounting a bulb within the cage, and suspension means for suspending the cage within the balloon; and wherein the cage is elongate and wherein the suspension means are mounted at spaced apart locations along an axis of elongation of the cage.

3. Apparatus for providing external lighting at an exposed external location comprising:

a balloon envelope for containing a quantity of buoyant gas sufficient to provide lift to the apparatus;

a light source;

means for supplying power to the light source;

means for suspending the light source from the balloon envelope; means for attaching the balloon envelope to a tether;

wherein the balloon envelope is configured to resist deflection by wind when attached to the tether;

wherein the means for suspending the light source from the balloon envelope comprises a cage, the cage having means for mounting a bulb within the cage, and suspension means for suspending the cage within the balloon; and wherein the suspension means are at spaced apart locations about the circumference of the cage.

4. Apparatus for providing external lighting at an exposed external location comprising:

a balloon envelope for containing a quantity of buoyant gas sufficient to provide lift to the apparatus;

a light source;

means for supplying power to the light source;

means for suspending the light source from the balloon envelope;

means for attaching the balloon envelope to a tether;

wherein the balloon envelope is configured to resist deflection by wind when attached to the tether;

wherein the means for suspending the light source from the balloon envelope comprises a cage, the cage having means for mounting a bulb within the cage, and suspension means for suspending the cage within the balloon; and wherein the cage has ventilation apertures to allow the buoyant gas to circulate in the vicinity of the bulb.

5. Apparatus for providing external lighting at an exposed external location comprising:

a balloon envelope for containing a quantity of buoyant gas sufficient to provide lift to the apparatus;

a light source;

means for supplying power to the light source;

means for suspending the light source from the balloon envelope;

means for attaching the balloon envelope to a tether;

wherein the balloon envelope is configured to resist deflection by wind when attached to the tether;

wherein the means for suspending the light source from the balloon envelope comprises a cage, the cage having means for mounting a bulb within the cage, and suspension means for suspending the cage within the balloon; and wherein the cage is arranged to accommodate a discharge bulb and wherein voltage booster means for boosting voltage supplied from a power supply to a voltage sufficient to ignite the discharge are provided with the cage.

6. Apparatus according to claim 1 having at least one external stabilizer.

7. Apparatus according to claim 6 having a plurality of stabilisers, preferably three stabilisers, preferably spaced substantially equally about the circumference of a tapered portion of the balloon.

8. Apparatus according to claim 1 having a reflector to reflect a portion of light from the light source in a desired direction, preferably downwardly.

9. Apparatus according to claim 1 wherein the means for suspending the light source from the balloon envelope comprises a cage, the cage having means for mounting a bulb within the cage, and suspension means for suspending the cage within the balloon.

10. Apparatus according to claim 1, wherein the cage contains a pre-installed bulb.

11. Apparatus according to claim 10, wherein the bulb is a discharge bulb.

12. Apparatus according to claim 1, wherein the balloon envelope is elongate.

13. Apparatus according to claim 1, wherein the cage is elongate.

14. Apparatus according to claim 1, wherein the bulb is elongate.

15. Apparatus according to claim 1, wherein the balloon envelope is elongate, wherein the cage is elongate and wherein the bulb is elongate and wherein the axes of elongation of the cage and of the bulb are generally aligned with the axis of elongation of the balloon.

16. Apparatus according to claim 1 wherein the cage comprises a transparent or translucent heat resistant material.

17. Apparatus according to claim 1, wherein the cage comprises a pair of substantially circular end members maintained spaced apart by at least one elongate longitudinal member.

* * * * *